US010995633B2

(12) United States Patent
Kusakabe

(10) Patent No.: US 10,995,633 B2
(45) Date of Patent: May 4, 2021

(54) TURBOFAN ENGINE

(71) Applicant: HONDA MOTOR CO., LTD., Tokyo (JP)

(72) Inventor: Yukio Kusakabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 55 days.

(21) Appl. No.: 16/590,560

(22) Filed: Oct. 2, 2019

(65) Prior Publication Data

US 2020/0208537 A1 Jul. 2, 2020

(30) Foreign Application Priority Data

Sep. 26, 2018 (JP) ..... JP2018-180099

(51) Int. Cl.
*F01D 25/24* (2006.01)

(52) U.S. Cl.
CPC ..... *F01D 25/24* (2013.01); *F05D 2220/323* (2013.01); *F05D 2240/14* (2013.01)

(58) Field of Classification Search
CPC ..... F01D 25/24; F01D 25/16; F01D 21/045; F01D 11/16; F01D 11/18; F05D 2240/14; F05D 2220/323; F02C 7/06; F16C 27/04; F04D 29/164
USPC ..... 415/213.1, 9, 173.3
See application file for complete search history.

(56) References Cited

U.S. PATENT DOCUMENTS 2,935,294 A * 5/1960 Angell ..... F01D 21/045 415/9
5,288,204 A * 2/1994 Adams ..... F04D 29/526 415/213.1
6,382,905 B1 * 5/2002 Czachor ..... F04D 29/164 415/9
8,425,178 B2 * 4/2013 Lenk ..... F01D 21/045 415/9
8,894,349 B2 * 11/2014 Harper ..... F01D 21/045 415/9
9,828,876 B2 * 11/2017 Kappes ..... F01D 21/045
2004/0146393 A1 * 7/2004 Evans ..... F01D 21/045 415/9
2011/0076132 A1 * 3/2011 Bottome ..... F01D 21/045 415/9
2013/0051981 A1 * 2/2013 Hindle ..... F01D 25/04 415/119
2013/0202430 A1 * 8/2013 Gaudry ..... F01D 25/243 415/214.1
2016/0169048 A1 * 6/2016 Grainger ..... F01D 21/045 415/213.1
2016/0233652 A1 8/2016 Goto et al.
(Continued)

FOREIGN PATENT DOCUMENTS

JP 2015061419 A 3/2015

*Primary Examiner* — Thai Ba Trieu
(74) *Attorney, Agent, or Firm* — Armstrong Teasdale LLP

(57) ABSTRACT

A turbofan engine includes: a cylindrical fan case; a fan rotatably disposed in the fan case and including a central member and multiple fan blades arranged on an outer circumference of the central member such that the fan blades are spaced apart from one another in a circumferential direction; an annular member disposed to surround the fan; and an elastic support device that supports the annular member to the fan case radially elastically such that a predetermined clearance is radially defined between the annular member and tips of the fan blades.

3 Claims, 5 Drawing Sheets

(56) References Cited

U.S. PATENT DOCUMENTS

| | | | | |
|---|---|---|---|---|
| 2016/0298642 | A1* | 10/2016 | Perdrigeon | F04D 29/526 |
| 2018/0118355 | A1* | 5/2018 | Pautis | B64D 27/26 |
| 2019/0193842 | A1* | 6/2019 | Kato | F01D 11/10 |

* cited by examiner

TURBOFAN ENGINE

TECHNICAL FIELD

The present invention relates to a turbofan engine, and particularly to a turbofan engine for aircraft.

BACKGROUND ART

In turbofan engines for aircraft, if foreign objects such as birds and hail (hailstones) collide with the fan disposed in the air inlet of the engine casing (cowl), the resulting impact may cause eccentricity (run-out) of the fan rotation shaft, which may cause a eccentric or conical rotation (which may be referred to as "whirling") of the fan. If the whirling of the fan occurs, the tips (outer edges) of the fan blades may hit the engine casing, which causes damage to the fan blades.

As a measure for preventing damage to the fan blades, it is known to provide a sacrificial abradable material layer on the engine casing such that when the whirling of the fan occurs, the tips of the fan blades come into contact with the abradable material layer, whereby damage to the fan blades can be avoided owing to the abrasion of the abradable material layer (JP2005-61419A, for example).

However, in the above prior art, the abrasion of the abradable material layer causes the clearance between the fan blades and the engine casing to increase steadily, and the loss of airflow caused thereby leads to a steady decrease in the thrust of the engine. In addition, the above prior art technology requires replacement and maintenance of the abradable material layer.

SUMMARY OF THE INVENTION

An object of the present invention is to provide a turbofan engine that can avoid damage to the fan blades due to collision with foreign objects, without inviting a steady decrease in the thrust of the turbofan engine.

One embodiment of the present invention provides a turbofan engine (10), comprising: a cylindrical fan case (12); a fan (28) rotatably disposed in the fan case and including a central member (20A) and multiple fan blades (29) arranged on an outer circumference of the central member such that the fan blades are spaced apart from one another in a circumferential direction; an annular member (102) disposed to surround the fan (28); and an elastic support device (104) that supports the annular member to the fan case radially elastically such that a predetermined clearance (E) is radially defined between the annular member and tips (29A) of the fan blade.

According to this arrangement, if the whirling of the fan occurs, the tips of the fan blades come into contact with the annular member, but the annular member moves radially (eccentric displacement) owing to the elastic support by the elastic support device. Thereby, damage to the fan blades due to collision with foreign objects can be avoided without inviting a steady decrease in the thrust of the turbofan engine. Further, owing to the elastic action of the elastic support device, the annular member is caused to return to its original position, and thus, the whirling of the fan is suppressed relatively quickly. This also contributes to preventing damage to the fan blades due to collision with foreign objects.

Preferably, the elastic support device (104) includes multiple spring members (112) provided at multiple positions around a central axis (A) of the fan case (12).

According to this arrangement, the spring members allow the elastic action of the elastic support device to be obtained appropriately.

Preferably, the elastic support device (104) includes: an annular recess (12A) formed on an inner circumferential surface of the fan case (12); multiple pins (108) provided at multiple positions around the central axis (A) of the fan case (12) and each having a base end fixed to a bottom of the annular recess (12A) and extending radially inward from the base end; and multiple sliders (110) each engaging a corresponding one of the pins (108) so as to be movable in an axial direction of the pin, wherein the spring members are constituted of compression springs (112) provided for the respective pins (108) such that each compression spring is disposed between a corresponding one of the sliders (110) and the bottom of the annular recess (12A) and urges the slider into contact with an outer circumferential surface (102A) of the annular member (102).

According to this arrangement, the compression springs allow the elastic action of the elastic support device to be obtained appropriately.

In another embodiment, the elastic support device (104) preferably includes: an annular recess (12A) formed on an inner circumferential surface of the fan case (12); multiple pins (108) provided at multiple positions around the central axis (A) of the fan case (12) and each having a base end fixed to a bottom of the annular recess (12A), extending radially inward from the base end, and having a free end provided with an enlarged diameter to form a flange (108A); and multiple sliders (110) each engaging a corresponding one of the pins (108) so as to be movable in an axial direction of the pin, with radially inward movement of the slider being restricted by the flange (108A) of the pin, wherein the spring members are constituted of compression springs (112) provided for the respective pins (108) such that each compression spring is disposed between a corresponding one of the sliders (110) and the bottom of the annular recess (12A) and urges the slider into contact with an outer circumferential surface (102A) of the annular member (102).

According to this arrangement also, the compression springs allow the elastic action of the elastic support device to be obtained appropriately. In addition, the assembly of the elastic support device is easy.

Preferably, the turbofan engine further comprises a caulking part (114) formed of a filler affixed to the fan case to fill a gap between the annular recess (12A) and the annular member (102).

According to this arrangement, a loss of airflow around the fan due to the arrangement of the annular recess and the annular member can be reduced.

Thus, the turbofan engine of the present invention can avoid engine damage to the fan blades due to collision with foreign objects without inviting a steady decrease in the thrust.

DESCRIPTION OF THE PREFERRED EMBODIMENT(S)

In the following, one embodiment of the turbofan engine according to the present invention will be described with reference to FIGS. 1 to 4.

Figure 1:
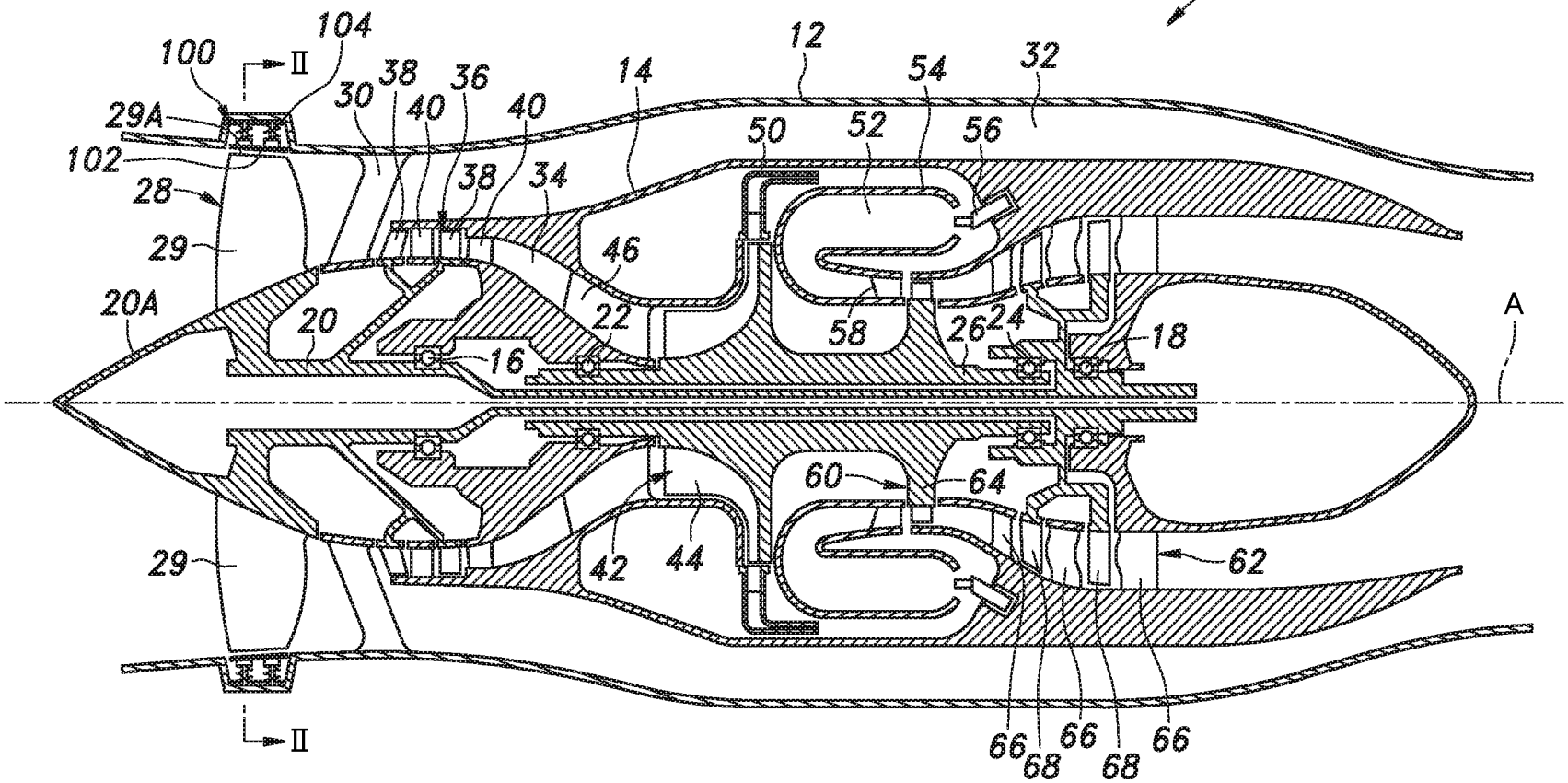
FIG. 1 is a sectional view showing an overall structure of an embodiment of a turbofan engine according to the present invention.

As shown in FIG. 1, a turbofan engine 10 is one type of a gas turbine engine and includes a substantially cylindrical outer casing 12 and an inner casing 14 that are arranged coaxially. The inner casing 14 rotatably supports a low pressure rotary shaft 20 therein via a front first bearing 16 and a rear first bearing 18. A tubular high pressure rotary shaft 26 is arranged so as to be rotatable around an outer circumference of an axially intermediate portion of the low pressure rotary shaft 20. The front portion of the high pressure rotary shaft 26 is supported by the inner casing 14 via a front second bearing 22 while the rear portion of the same is supported by the low pressure rotary shaft 20 via a rear second bearing 24. The low pressure rotary shaft 20 and the high pressure rotary shaft 26 are arranged coaxially, and the central axis thereof is denoted by a reference sign "A."

The low pressure rotary shaft 20 includes a substantially conical tip portion 20A that protrudes more forward than the inner casing 14. An outer circumference of the tip portion 20A is provided with a front fan 28 including multiple fan blades 29, which are made of titanium alloy or the like and arranged to be spaced apart from one another in the circumferential direction, such that the front fan 28 is rotatable around the central axis A within the outer casing 12. Thereby, the outer casing 12 serves as a cylindrical fan case, the low pressure rotary shaft 20 serves as a fan rotation shaft, and the tip portion 20A of the low pressure rotary shaft 20 serves as a central member of the front fan 28. Around the outer circumference of the front fan 28 is provided a fan damage prevention structure 100, which will be described in detail later. Tips (outer edges) 29A of the fan blades 29 as a whole form a substantially circular outline about the central axis A in front view (see FIG. 2).

Multiple stator vanes 30, each having an outer end joined to the outer casing 12 and an inner end joined to the inner casing 14, are arranged on a downstream side of the front fan 28 so as to be spaced apart from one another at a predetermined interval in the circumferential direction. On a downstream side of the stator vanes 30, a bypass duct 32 defined between the outer casing 12 and the inner casing 14 to have an annular cross-sectional shape and an air compression duct (annular fluid passage) 34 defined coaxially (to be coaxial with the central axis A) in the inner casing 14 to have an annular cross-sectional shape are provided in parallel with each other.

An axial compressor 36 is provided in an inlet of the air compression duct 34. The axial compressor 36 includes two (front and rear) rotor blade rows 38 provided on an outer circumference of the low pressure rotary shaft 20 and two (front and rear) stationary blade rows 40 provided in the inner casing 14, such that the rotor blade rows 38 and the stationary blade rows 40 are arranged adjacent to each other and alternate in the axial direction.

A centrifugal compressor 42 is provided in an outlet of the air compression duct 34. The centrifugal compressor 42 includes impellers 44 provided on an outer circumference of the high pressure rotary shaft 26. A stationary blade row 46 is provided in the outlet of the air compression duct 34 on an upstream side of the impellers 44. Further, a diffuser 50 is provided at an outlet of the centrifugal compressor 42, wherein the diffuser is fixed to the inner casing 14.

On a downstream side of the diffuser 50, a combustion chamber member 54 is provided to define a reverse-flow combustion chamber 52 to which compressed air is supplied from the diffuser 50. The inner casing 14 is provided with multiple fuel injection nozzles 56 for injecting fuel into the reverse-flow combustion chamber 52. The reverse-flow combustion chamber 52 produces high-pressure combustion gas by combusting air-fuel mixture therein. A nozzle guide vane row 58 is provided in an outlet of the reverse-flow combustion chamber 52.

On a downstream side of the reverse-flow combustion chamber 52, a high pressure turbine 60 and a low pressure turbine 62 are provided such that the combustion gas produced in the reverse-flow combustion chamber 52 is blown thereto. The high pressure turbine 60 includes a high pressure turbine wheel 64 fixed to an outer circumference of the high pressure rotary shaft 26. The low pressure turbine 62 is provided on a downstream side of the high pressure turbine 60 and includes multiple nozzle guide vane rows 66 fixed to the inner casing 14 and multiple low pressure turbine wheels 68 provided on an outer circumference of the low pressure rotary shaft 20 arranged in an axially alternating manner.

At the start of the turbofan engine 10, a starter motor (not shown in the drawings) drives the high pressure rotary shaft 26 to rotate. Once the high pressure rotary shaft 26 starts rotating, the air compressed by the centrifugal compressor 42 is supplied to the reverse-flow combustion chamber 52, and air-fuel mixture combustion takes place in the reverse-flow combustion chamber 52 to produce combustion gas. The combustion gas is blown to the high pressure turbine wheel 64 and the low pressure turbine wheels 68 to rotate the turbine wheels 64, 68.

Thereby, the low pressure rotary shaft 20 and the high pressure rotary shaft 26 rotate, which causes the front fan 28 to rotate and brings the axial compressor 36 and the centrifugal compressor 42 into operation, whereby the compressed air is supplied to the reverse-flow combustion chamber 52. Therefore, the turbofan engine 10 continues to operate after the starter motor is stopped.

During the operation of the turbofan engine 10, part of the air suctioned by the front fan 28 passes through the bypass duct 32 and is blown out rearward, and generates the main thrust particularly in a low-speed flight. The remaining part of the air suctioned by the front fan 28 is supplied to the reverse-flow combustion chamber 52 and mixed with the fuel and combusted, and the combustion gas is used to drive the low pressure rotary shaft 20 and the high pressure rotary shaft 26 to rotate before being blown out rearward to generate thrust.

Figure 2:
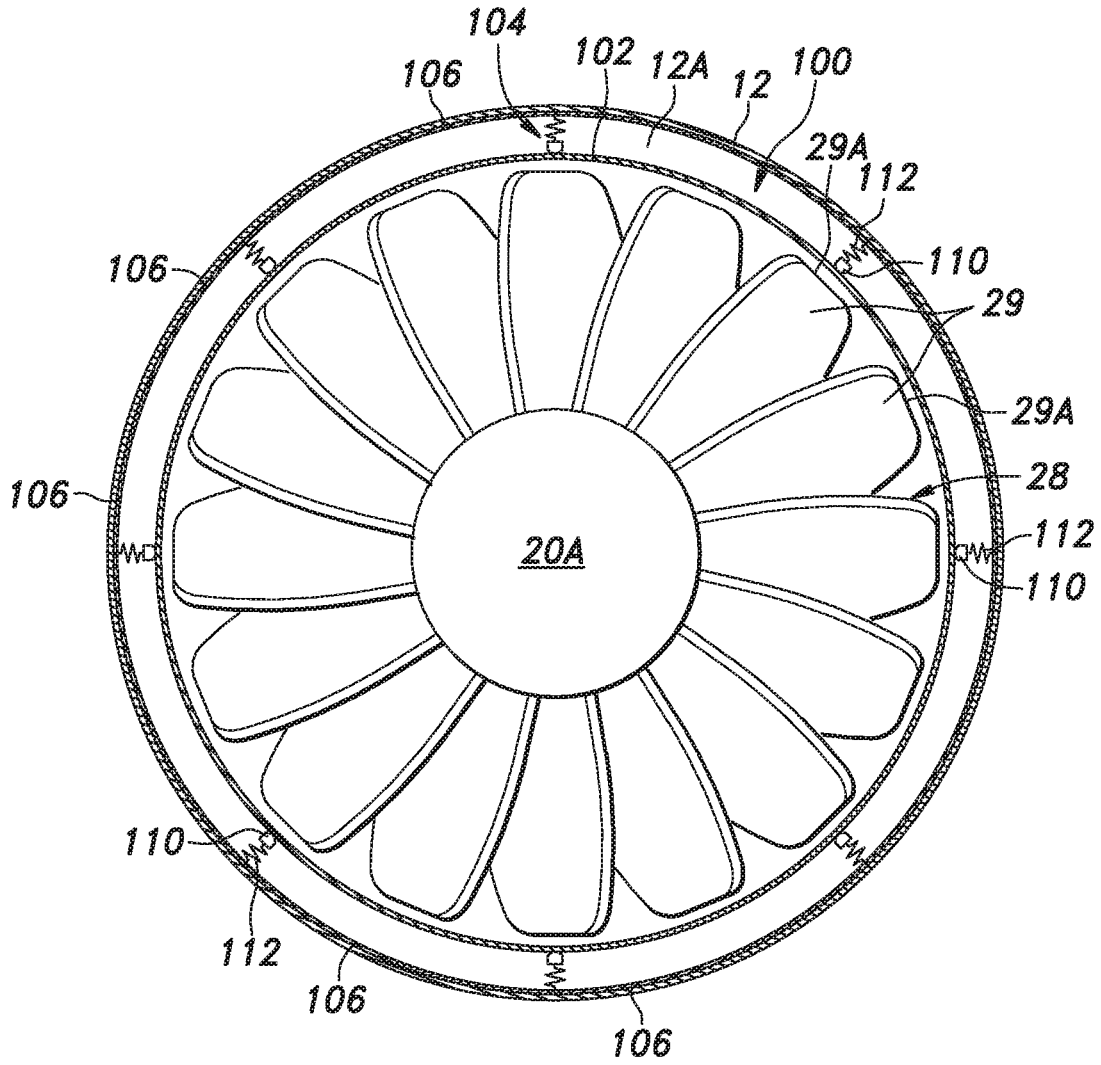
FIG. 2 is a sectional view taken along line II-II in FIG. 1.

Next, the fan damage prevention structure 100 will be described in detail with reference to FIGS. 2 to 4.

A part of the outer casing 12 axially aligned with the fan blades 29 is formed with an annular recess 12A the outer casing 12 such that the annular recess 12A is recessed in the inner surface of the outer casing 12. An annular member 102 is disposed in the outer casing 12 at a position surrounding the front fan 28 from outside by means of an elastic support device 104. The annular member 102 is formed by molding a plate member made of nickel alloy into a seamless cylindrical shape.

The elastic support device 104 includes a cylindrical body divided into multiple segments 106 in the circumferential direction at regular or irregular pitches. The segments 106 are arranged in the bottom of the annular recess 12A to jointly form the cylindrical body. Each segment 106 has two pins (slider rods) 108 attached thereto such that the two pins 108 are spaced apart from each other in the axial direction. Each of the two pins 108 of each segment 106 has a base end fixed to the segment 106 (or bottom of the annular recess 12A) and extends from the base end radially inward to protrude toward the center of the outer casing 12. As will be appreciated from FIGS. 2 and 4, the pins 108 are provided at multiple positions around the central axis A of the outer casing 12, and more specifically, the pins 108 are arranged at regular intervals in the circumferential direction around the central axis A of the outer casing 12. Each pin 108 is inserted into a hole 110A of a block-shaped slider 110, whereby the slider 110 engages the pin 108 to be movable in the axial direction of the pin 108.

Between each segment 106 and each of the sliders 110 associated with the segment 106, a compression coil spring 112 having a predetermined spring constant is disposed for each pin 108. As shown in FIG. 2, the compression coil springs 112 are arranged at regular intervals in the circumferential direction around the central axis A of the outer casing 12 and are each preloaded to cause a radially inner end surface 110B of the associated slider 110 to slidably contact an outer circumferential surface 102A of the annular member 102. Thus, each compression coil spring 112 urges the corresponding slider 110 into slidable contact with the outer circumferential surface 102A of the annular member 102, while allowing the slider 110 to move elastically in the radial direction. In the illustrated embodiment, the radial movement of the slider 110 is guided by the corresponding pin 108. The spring constant required for each compression coil spring 112 relates to the bending stiffness of the low pressure rotary shaft 20, the size of the annular member 102, the weight of the front fan 28, etc., and therefore, the spring constant may be set depending on these factors.

With the above configuration, the elastic support device 104 including the compression coil springs 112 supports the annular member 102 coaxially with the front fan 28 and radially elastically such that a radial clearance E (see FIG. 3) is defined between an inner circumferential surface 102B of the annular member 102 and the tips 29A of the fan blades 29. In other words, the annular member 102 is supported by the elastic support device 104 in a floating manner in the outer casing 12 while defining the clearance E with the tips 29A of the fan blades 29 in the radial direction such that, when no external force is applied, the annular member 102 is positioned coaxially with the outer casing 12 and the front fan 28, and the inner circumferential surface 102B of the annular member 102 is substantially continuous with (or flush with) parts of an inner circumferential surface 34A of the air compression duct 34 located in front of and behind the annular member 102 in the axial direction. Thereby, the annular member 102 is prevented from becoming a flow resistance in the air compression duct 34.

Figure 3:
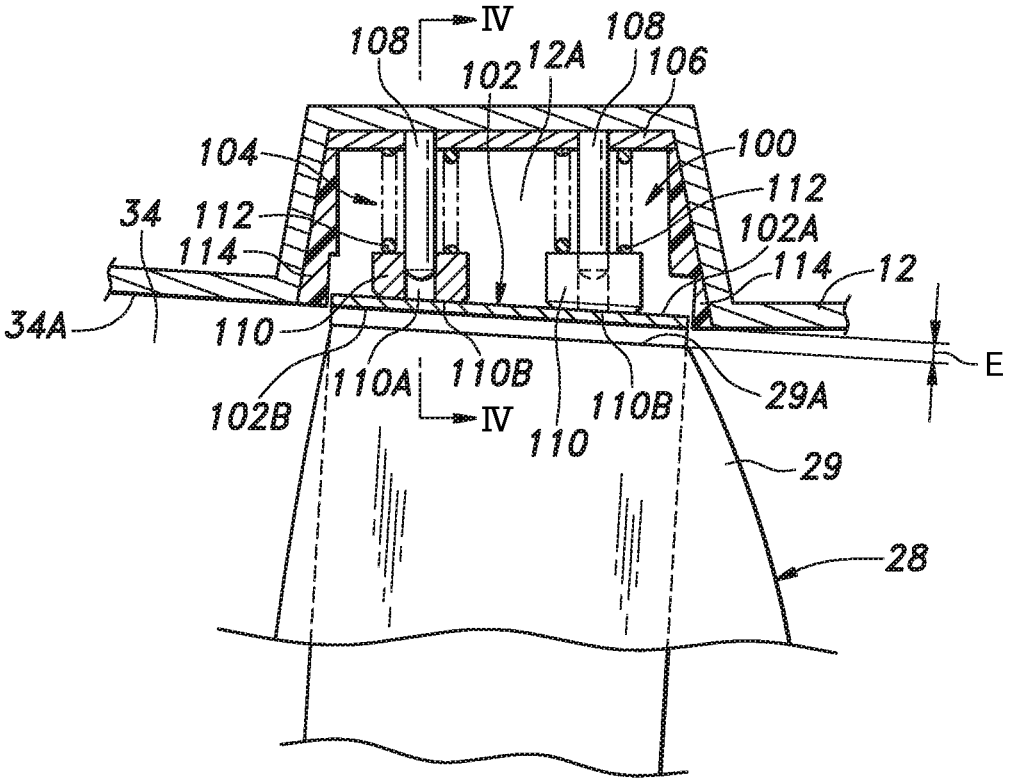
FIG. 3 is an enlarged sectional view of a part (fan damage prevention structure) of the turbofan engine.
Figure 4:
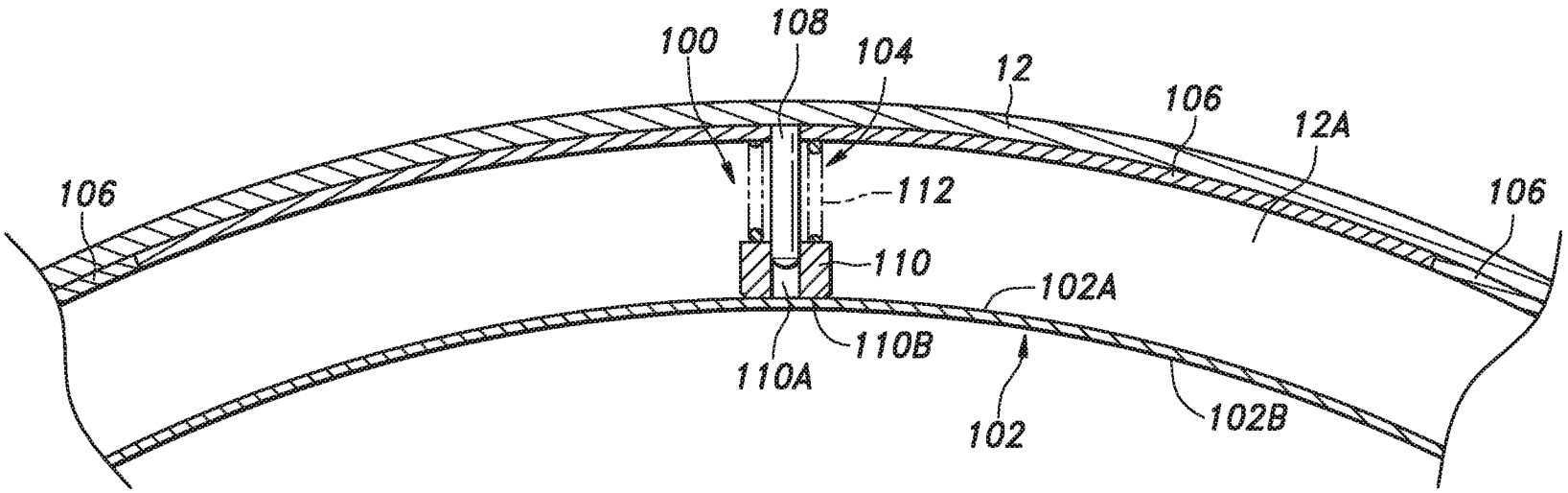
FIG. 4 is a sectional view taken along line IV-IV in FIG. 3.

The outer casing 12 is provided with caulking parts 114 each formed of a filler affixed to the outer casing 12 to fill a gap created between the inner surface of the annular recess 12A and the annular member 102 (see FIG. 3).

This reduces a loss of airflow around the front fan 28 due to the arrangement of the annular recess 12A and the annular member 102. It is to be noted that the caulking parts 114 are provided to hinder the floating support of the annular member 102 or eccentric displacement of the annular member 102.

The mount base of the pins 108 is constituted of the multiple segments 106, and this allows the pins 108, the compression coil springs 112, etc. to be assembled easily in the annular recess 12A.

In the fan damage prevention structure 100 described above, when foreign objects collide with the front fan 28 and the impact thereof causes eccentricity of the low pressure rotary shaft 20 and whirling (eccentric or conical rotation) of the front fan 28, the tips 29A of the fan blades 29 come into contact with the inner circumferential surface 102B of the annular member 102, and under compressive deformation of the compression coil springs 112 positioned on the collision side, the annular member 102 moves in a radial direction (eccentric displacement). Thereby, damage to the fan blades 29 due to collision with foreign objects can be avoided without inviting a steady decrease in the thrust of the turbofan engine 10. Thereafter, the annular member 102 is returned to its original position due to the repulsive force of the compression coil springs 112 or elastic action of the elastic support device 104.

Because the compression coil springs 112 having a predetermined spring constant are used, though the fan blades 29 may contact the annular member 102, the annular member 102 can return to its original position owing to the repulsive force of the compression coil springs 112, so that the whirling of the front fan 28 is suppressed quickly. This contributes to preventing damage to the fan blades 29 due to collision with foreign objects.

Figure 5:
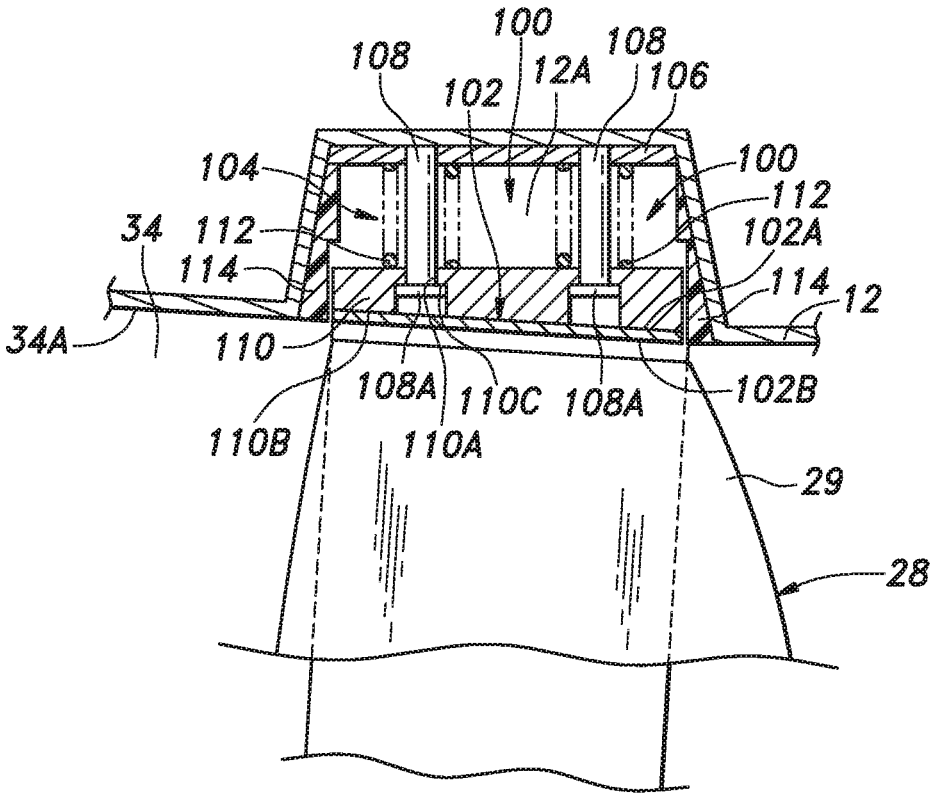
FIG. 5 is an enlarged sectional view of a part (fan damage prevention structure) of a turbofan engine according to another embodiment.

Next, another embodiment of the fan damage prevention structure 100 will be described with reference to FIG. 5. It is to be noted that parts shown in FIG. 5 corresponding to those shown in FIG. 3 are denoted by the same reference numerals as in FIG. 3, and a detailed description thereof will be omitted.

In this embodiment, a single slider 110 is supported by two pins 108 for each segment 106. Each pin 108 has a free end formed with a flange 108A having an enlarged diameter. Each engagement hole 110A of the slider 110 is formed with an enlarged diameter portion defining a shoulder portion 110C, such that the flange 108A abuts against the shoulder portion 110C to restrict the movement of the slider 110 in the radially inward direction.

In this embodiment, the slider 110 is prevented from inadvertently dropping off before the annular member 102 has been installed, and therefore, the assembly of the fan damage prevention structure 100 becomes easy. Other features of this embodiment are the same as in the previous embodiment, and therefore, the same advantages as in the previous embodiment can be obtained in this embodiment also.

In the foregoing, the present invention has been described in terms of the preferred embodiments thereof, but the present invention is not limited to the foregoing embodiments and various alterations and modifications may be made as appropriate. Also, not all of the structural elements shown in the above embodiment(s) are necessarily indispensable and they may be selectively used as appropriate without departing from the scope of the present invention.

The invention claimed is:

1. A turbofan engine, comprising:

a cylindrical fan case;

a fan rotatably disposed in the fan case and including a central member and multiple fan blades arranged on an outer circumference of the central member such that the fan blades are spaced apart from one another in a circumferential direction;

an annular member disposed to surround the fan; and an elastic support device that supports the annular member to the fan case radially elastically such that a predetermined clearance is radially defined between the annular member and tips of the fan blades, wherein the elastic support device further includes:

multiple spring members provided at multiple positions around a central axis of the fan case;

an annular recess formed on an inner circumferential surface of the fan case;

multiple pins provided at multiple positions around the central axis of the fan case and each having a base end fixed to a bottom of the annular recess and extending radially inward from the base end; and multiple sliders each engaging a corresponding one of the pins so as to be movable in an axial direction of the pin, wherein the spring members are constituted of compression springs provided for the respective pins such that each compression spring is disposed between a corresponding one of the sliders and the bottom of the annular recess and urges the slider into contact with an outer.

2. The turbofan engine according to claim 1, further comprising a caulking part formed of a filler affixed to the fan case to fill a gap between the annular recess and the annular member.

3. A turbofan engine, comprising:

a cylindrical fan case;

a fan rotatably disposed in the fan case and including a central member and multiple fan blades arranged on an outer circumference of the central member such that the fan blades are spaced apart from one another in a circumferential direction;

an annular member disposed to surround the fan; and an elastic support device that supports the annular member to the fan case radially elastically such that a predetermined clearance is radially defined between the annular member and tips of the fan blades, wherein the elastic support device further includes:

multiple spring members provided at multiple positions around a central axis of the fan case;

an annular recess formed on an inner circumferential surface of the fan case;

multiple pins provided at multiple positions around the central axis of the fan case and each having a base end fixed to a bottom of the annular recess, extending radially inward from the base end, and having a free end provided with an enlarged diameter to form a flange; and multiple sliders each engaging a corresponding one of the pins so as to be movable in an axial direction of the pin, with radially inward movement of the slider being restricted by the flange of the pin, wherein the spring members are constituted of compression springs provided for the respective pins such that each compression spring is disposed between a corresponding one of the sliders and the bottom of the annular recess and urges the slider into contact with an outer.

* * * * *